United States Patent [19]

Gandy

[11] Patent Number: 4,674,214

[45] Date of Patent: Jun. 23, 1987

[54] SIGN

[75] Inventor: James Gandy, Mississauga, Canada

[73] Assignee: Signtech Inc., Mississauga, Canada

[21] Appl. No.: 772,103

[22] Filed: Sep. 3, 1985

[30] Foreign Application Priority Data

Apr. 25, 1985 [CA] Canada ..... 480129

[51] Int. Cl.[4] ..... G09F 1/12

[52] U.S. Cl. ..... 40/603; 40/156; 40/155

[58] Field of Search ..... 40/156, 603, 564; 160/378, 392, 395

[56] References Cited

U.S. PATENT DOCUMENTS

| | | | |
|---|---|---|---|
| 4,317,302 | 3/1982 | Von De Linde | 40/156 |
| 4,441,269 | 4/1984 | Dahl | 40/156 |
| 4,554,754 | 11/1985 | Stilling | 40/603 |

*Primary Examiner*—Gene Mancene
*Assistant Examiner*—Wenceslao J. Contreras
*Attorney, Agent, or Firm*—Robert F. Delbridge; Arne I. Fors

[57] ABSTRACT

A sign has a rigid peripheral frame extending around an opening lying in a plane, and a sheet of flexible sign material extends across the opening. The frame has an edge surrounding the opening, and the flexible sign material has a peripheral edge portion extending over the edge and rearwardly from the plane of the opening. A series of separate sheet tensioning devices is spaced around the frame rearwardly of the plane of the opening, each tensioning device comprising means for retaining the peripheral edge portion of the flexible sign material and means for adjusting the position of the retaining means relatively to the frame to cause the peripheral edge portion of the flexible sign material to be pulled rearwardly across the frame edge to tension the flexible sign material across the opening. Each retaining means includes a first member having a recess extending longitudinally of and facing the frame edge, the recess being open at at least one end of the first member, and a second member having a first part engageable by the adjusting means and a second part insertable into the recess in the first member by relative longitudinal movement into an open end thereof. The recess of the first member and the second part of the second member are shaped to cause the first member to prevent movement of the second part of the second member out of the recess in a forward direction, and the peripheral edge portion of the flexible sign material is wrapped around the second part of the second member in the recess and thereby retained by the tensioning device.

4 Claims, 6 Drawing Figures

SIGN

Figure 1:
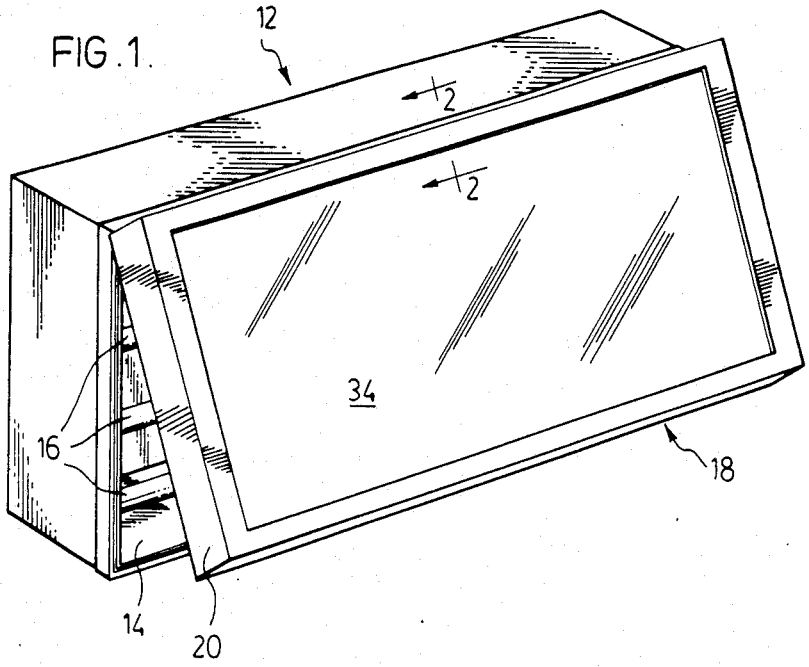

This invention relates to signs which have a sheet of flexible sign material stretched across an opening in a frame.

A sign of this kind is disclosed in U.S. Pat. No. 4,452,000 (Gandy) issued June 5, 1984.

This prior patent is primarily concerned with an improved means of tensioning the sheet of flexible sign material across the opening in the frame. A series of separate tensioning devices are spaced around the frame rearwardly of the plane of the opening, with each tensioning device comprising means for retaining the peripheral edge portion of the flexible sign material and means for adjusting the position of the retaining means relatively to the frame to cause the peripheral edge portion of the flexible sign material to be pulled rearwardly across an edge of the frame to tension the flexible sign material across the opening.

It is an object of the present invention to provide improved means for retaining the peripheral edge portion of the flexible sign material in each tensioning device.

According to the present invention, each retaining means comprising a first member having a recess extending longitudinally of and facing the frame edge, with the recess being open at at least one end of the first member, and a second member having a first part engageable by the adjusting means and a second part insertable into the recess by relative longitudinal movement into an open end thereof. The recess in the first member and the second part of the second member are shaped to cause the first member to prevent movement of the second part of the second member out of the recess of the first member in a forward direction, and the peripheral edge portion of the flexible sign material is wrapped around the second part of the second member in the recess and thereby retained by the tensioning device.

Preferably, the flexible sign material extends rearwardly from the frame edge around the rear of the first member and through the recess in the first member behind the second part of the second member. The adjusting means may comprise a bolt extending through the first part of the second member and threaded into an aperture in the frame.

U.S. Pat. No. 4,380,880 (Gandy) issued Apr. 26, 1983 discloses a U-shaped hinge member which enables a sign of the type concerned to be hinged at the top to the top of a housing to form a sign assembly. The present invention also provides an improved manner of connecting such a hinge member to the frame.

According to a further feature of the invention therefore, a sign assembly comprises a sign as previously described in assembly with a housing having a top, a substantially horizontal shelf adjacent the top and a downwardly extending lip below the shelf. The sign frame has a rearwardly projecting substantially horizontal flange adjacent the top, with the flange having a free end portion resting on the shelf of the housing. A hinge member has a generally U-shaped section with upwardly extending spaced arms connected by a bight, the bight being located below the downwardly extending lip of the housing with one arm extending upwardly on one side of the lip below the frame flange with there being means detachably securing the said one arm of the hinge member to the flange, and the other arm of the hinge member extending upwardly on the opposite side of the lip to the said one arm to retain the sign frame in assembly with the housing while permitting limited upward pivotal movement of the sign frame relative to the housing by pivoting of the free end of the flange on the shelf. The means detachably securing said one arm of the hinge member to the sign frame comprises screw threaded means extending through the flange into a medial portion of the said one arm of the hinge member on opposite longitudinal sides of the screw threaded means into resilient engagement with the underside of the flange.

Figure 2:
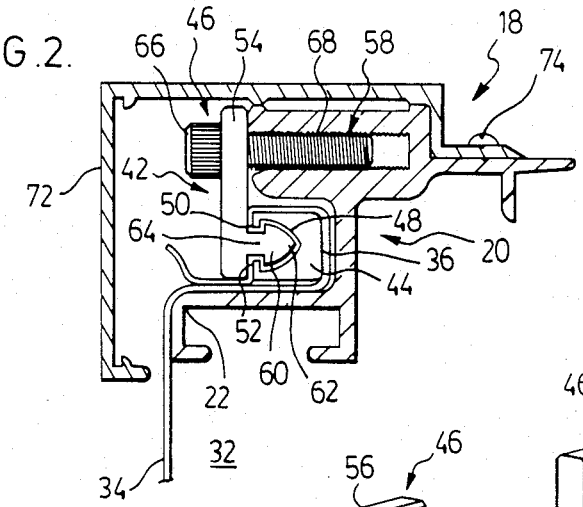
Figure 3:
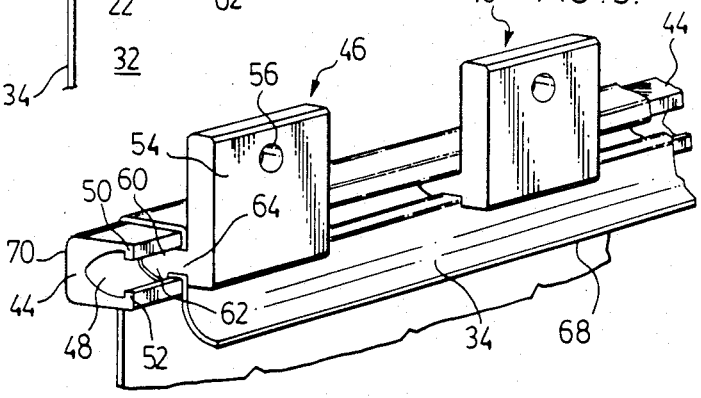
Figure 4:
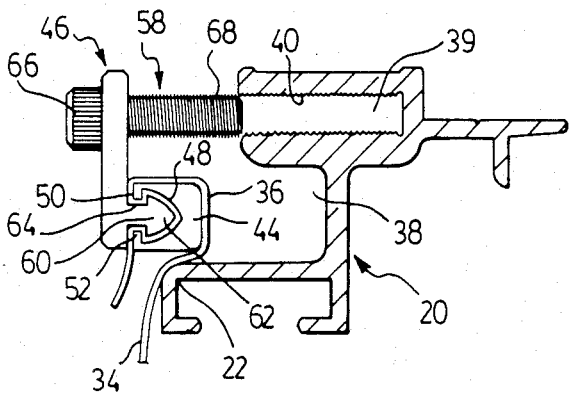
Figure 5:
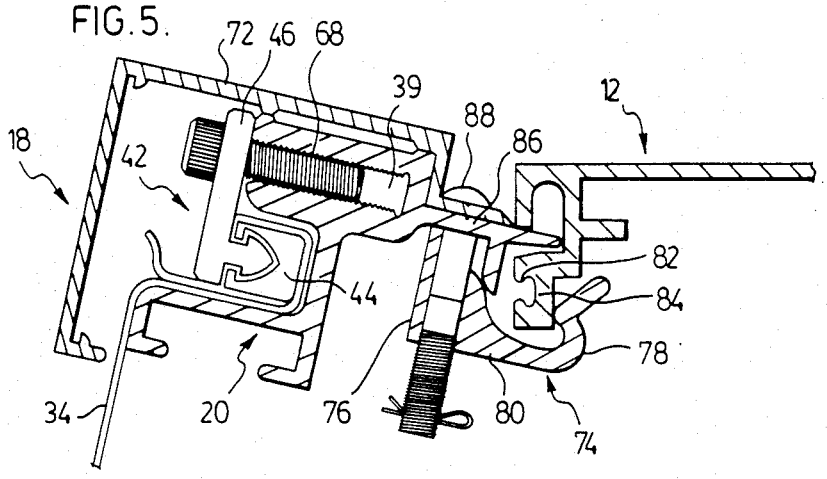
Figure 6:
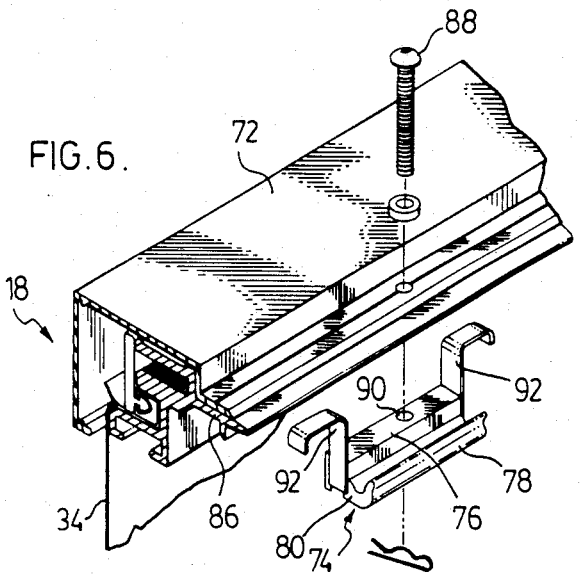

One embodiment of the invention will now be described, by way of example, with reference to accompanying drawings, of which:

FIG. 1 is a perspective view of a sign assembly,

FIG. 2 is a sectional view of the sign along the line 2—2 of FIG. 1, showing the improved means for retaining the flexible sign material, FIG. 3 is an enlarged view of the improved retaining means, FIG. 4 is a sectional view similar to FIG. 2, but showing the retaining means in an initial stage of tensioning movement, FIG. 5 is a sectional view generally similar to FIG. 2, but also showing a hinge member connecting the sign frame to the top of the housing, and FIG. 6 is an exploded view showing more detail of the hinge member.

Referring to the drawings, a sign assembly comprises a rectangular box-like housing 12 with an open front 14 and containing a series of fluorescent lamps 16 in known manner. A sign 18 extends over the open front 14 of the housing 12, and is hinged thereto at the top in a manner which will be described in more detail later. The sign 18 has a rigid rectangular frame 20 with four extruded sides secured together by appropriate brackets (not shown) at the corners in a manner which will be readily apparent to a person skilled in the art.

The frame 20 has an edge 22 defining the periphery of an opening 32. A flexible sheet of translucent sign material 34 extends across the opening 32 and has a peripheral edge portion 36 extending rearwardly from the frame edge 22. Rearwardly of the frame edge 22, the frame 18 has a lower recess 38 and an upper recess 39 whose opposed parallel walls have ribs 40 extending therealong.

A series of separate tensioning devices 42 are spaced around the frame 22 rearwardly of the plane of the opening 32. Each tensioning device 42 has means for retaining the peripheral edge portion 36 of the flexible sign material 34 which comprises a first member 44 and a second member 46. The first member 44 is in the form of a short longitudinal extending bar with a forwardly facing recess 48 open at each end. The recess 48 has a generally concavely curved section with upper and lower projections 50, 52 at the front extending partially across the mouth of the recess 48.

Each second member 46 has a first part 54 with an aperture 56 for receiving a bolt 58 as will be described in more detail later, and a second part 60 extending inwardly from the lower end of the first part 54. The second part 60 is in the form of a longitudinally extending rib with a bulbous section 62 corresponding to that of recess 48 and a neck 64 immediately adjacent the first part 54.

To install the flexible sign material 34, the peripheral edge portion 36 is assembled with each separate tensioning device 42 in turn by wrapping the peripheral edge portion 36 around the rear of the first member 44 and then folded forwardly down over the front of the first member 44 and pushed into the recess 48. The second part 60 of the second member 46 is then assembled with the first member 44 by sliding the bulbous rib section 62 into the recess 48 from one end so that the peripheral edge portion 36 is retained in the recess 48 by the second part 60 of the second member 46, as shown in FIG. 4.

A bolt 58 is then passed through the aperture 56 so that its head 66 engages the first part 54 of the second member 46, and its shank 68 threadingly engages the ribs 40 in the recess 48 in the sign frame 20. The peripheral edge portion 36 of the flexible sign material 34 is attached in this manner to each tensioning device 42. The bolts 58 of each tensioning device 42 are then successively screwed into the frame 20, with the first retainer member 44 entering the frame recess 38 to tension the flexible sign material 34 across the opening 32.

The flexible sign material 34 is thus easily assembled with the tensioning devices 42 in accordance with the present invention. The tensioning devices 42 securely retain the peripheral edge portion 36 of the flexible sign material 34, and easy to operate to tension the flexible sign material 34 across the opening 32 in a satisfactory manner.

If desired, the rear face of each first retaining member 44 may be longitudinally ribbed as shown at 70 in FIG. 2 to provide a further anti-slipping force on the peripheral edge portion 36 of the flexible sign material 34. It will be understood that each tensioning device 42 has individual first and second retainer members 44, 46 so as to be independent of other tensioning devices. Thus, FIG. 3 shown the first and second retainer members 44, 46 of two adjacent spaced tensioning devices.

An elongated cover 72 may be provided on each side of the sign frame 20 to conceal the tensioning devices 42 after tensioning of the flexible sign material 34 across the opening 32. The cover 72 may be secured to the frame 20 by screws 74.

FIGS. 5 and 6 show the manner in which the sign 18 can be hinged to the housing 12, the hinge member now to be described being an improvement in the hinge member described in the previously mentioned U.S. Pat. No. 4,380,880.

The hinge structure comprises a series of spaced hinge members 74 each having a generally U-shaped section with upwardly extending spaced arms 76, 78 connected by a bight 80. The front of the housing 12 has a shalf 82 at the top, with a lip 84 extending downwardly from the shelf 82, and the sign frame 20 has a rearwardly projecting flange 86 whose free end portion rests on the shelf 82. The bight 80 of the hinge member 74 is located below the downwardly extending lip 84, and the arm 76 of the hinge member 74 extends upwardly on the side of the lip 84 below the flange 86. A screw 88 passes through the flange 86 and into a threaded hole 90 in the top surface of the arm 76 midway along its length to detachably secure the flange 86 to the arm 76. As indicated in FIGS. 5 and 6, the screw 80 may also pass through the cover 72.

A pair of leaf springs 92 extend upwardly from opposite ends of the arm 76 of each hinge member 74, and curve outwardly and downwardly at their upper ends to provide curved upper portions 94 which engage the underside of the flange 86 to maintain the hinge member 74 in parallel relationship with the flange 86 during assembly.

As shown in FIG. 5, the sign frame 20 is thereby hinged at the top to the top of the housing 12 so that the sign 18 can be swung away from the housing 12 at the bottom to permit access to the interior of the housing 12 for cleaning and maintenance purposes. By loosening the screws 88, the hinge member 74 and hence the frame 18 can be detached from the housing 12, and more fully described in previously mentioned U.S. Pat. No. 4,380,880. A split pin 94 can be inserted through an opening in the lower end of each screw 88 to retain each hinge member 74 in loose assembly with the frame 18 during a frame removal operation.

Instead of sliding in from one end as previously described, it is also possible to assemble the second member 46 and peripheral edge portion 36 of the sign material 34 with the first member 44 by forcing the bulbous rib section 62 with the peripheral edge portion 36 of the sign material 34 wrapped therearound into the recess 48 past the upper and lower projections 50, 52, i.e. by movement of the second member 46 in a direction perpendicular to the length of the recess 48.

Other embodiments of the invention will be readily apparent to a person skilled in the art, the scope of the invention being defined in the appended claims.

That I claim as new and desire to protect by Letters Patent of the United States is:

1. A sign comprising a rigid peripheral frame extending around an opening lying in a plane, a sheet of flexible sign material extending across the opening, said frame having an edge surrounding the opening, the flexible sign material having a peripheral edge portion extending over the edge and rearwardly from the plane of the opening, and a series of separate sheet tensioning devices spaced around the frame rearwardly of the plane of the opening, each tensioning device comprising means for retaining the peripheral edge portion of the flexible sign material and means for adjusting the position of the retaining means relatively to the frame to cause the peripheral edge portion of the flexible sign material to be pulled rearwardly across the frame edge to tension the flexible sign material across the opening, each retaining means comprising a first member having a recess extending longitudinally of and facing the frame edge, the recess being open at at least one end of the first member, and a second member having a first part engaged by said adjusting means and a second part inserted into the recess in the first member by relative longitudinal movement into an open end thereof, said recess of said first member and said second part of said second member being shaped to cause the first member to prevent movement of the second part of the second member out of the recess in a forward direction, and the peripheral edge portion of the flexible sign material being wrapped around the second part of the second member in the recess and thereby being retained by the tensioning device.

2. A sign according to claim 1 wherein the flexible sign material extends rearwardly from the frame edge around the rear of the first member and through the recess behind the second part of the second member.

3. A sign according to claim 1 wherein each adjusting means comprises a bolt extending through the first part of the second member and threaded into an aperture in the frame.

4. A sign assembly comprising a sign according to claim 1 and a housing having a top, a substantially horizontal shelf adjacent the top and a downwardly extending lip below the shelf, the frame of the sign having a top, a rearwardly projecting substantially horizontal flange adjacent the top, the flange having a free end portion resting on the shelf of the housing, and a hinge member with a generally U-shaped section with upwardly extending spaced arms connected by a bight, the bight being located below the downwardly extending lip of the housing with one arm extending upwardly on one side of the lip below the flange, means detachably securing said one arm of the hinge member to the flange, and the other arm of the hinge member extending upwardly on the opposite side of the lip to said one arm to retain the frame in assembly with the housing while permitting limited upward pivotal movement of the frame relative to the top of the housing by pivoting of the free end of the flange on the shelf, and means detachably securing said one arm of the hinge member to the frame flange comprising screw means extending through the flange into a medial portion of the said one arm and resilient means extending upwardly from said one arm on opposite longitudinal sides of the screw threaded means to resilient engagement with the underside of the flange.

* * * * *